US005370748A

United States Patent [19]

Suga et al.

[11] Patent Number: 5,370,748

[45] Date of Patent: Dec. 6, 1994

[54] PROCESS FOR MANUFACTURING DOUBLE ORIENTED ELECTRICAL STEEL SHEET HAVING HIGH MAGNETIC FLUX DENSITY

[75] Inventors: Yozo Suga; Yoshiyuki Ushigami, both of Kitakyushu, Japan

[73] Assignee: Nippon Steel Corporation, Tokyo, Japan

[21] Appl. No.: 974,354

[22] Filed: Nov. 10, 1992

Related U.S. Application Data

[63] Continuation of Ser. No. 685,893, Apr. 16, 1991, abandoned.

[30] Foreign Application Priority Data

Apr. 20, 1990 [JP] Japan ..... 2-103182

[51] Int. Cl.[5] ..... C21D 8/12

[52] U.S. Cl. ..... 148/111; 148/112; 148/113

[58] Field of Search ..... 148/111, 112, 113, 307, 148/308

[56] References Cited

U.S. PATENT DOCUMENTS 3,640,780 2/1972 Stanley ..... 148/112
4,997,493 3/1991 Ushigami et al. ..... 148/111

FOREIGN PATENT DOCUMENTS 35-2657B 3/1960 Japan .
37-7110B 7/1962 Japan .
38-8213B 6/1963 Japan .
40-15644B 7/1965 Japan .
51-13469B 4/1976 Japan .
01-139722 6/1989 Japan .
139722A 6/1989 Japan ..... 148/113
1-272718A 10/1989 Japan .
2-141531A 5/1990 Japan .

*Primary Examiner*—Richard O. Dean
*Assistant Examiner*—Sikyin Ip
*Attorney, Agent, or Firm*—Wenderoth, Lind & Ponack

[57] ABSTRACT

The present invention is a process for manufacturing a double oriented electrical steel sheet having a high magnetic flux density by carrying out a low temperature annealing for the secondary recrystallization by the use of AlN as inhibitor, characterized by hot-rolling a silicon steel slab comprising 1.8–4.8% by weight of Si, 0.008–0.048% by weight of acid soluble Al, 0.0028–0.0100% by weight of acid soluble Al, 0.0028–0.0100% by weight of total N, not more than 0.016% by weight of S and the balance being Fe and unavoidable impurities into a hot-rolled sheet, subjecting the sheet to cold-rolling at a reduction rate of 40–80%, subsequently subjecting the sheet to another cold-rolling at a reduction rate of 30–70% in the direction crossing the cold-rolled direction, annealing at 750°–950° C. in a wet hydrogen atmosphere for decarburization, and carrying out the final finishing annealing which comprises a stage for completing the secondary recrystallizing at a temperature of 920°–1100° C., followed by a stage for purification.

4 Claims, 2 Drawing Sheets

PROCESS FOR MANUFACTURING DOUBLE ORIENTED ELECTRICAL STEEL SHEET HAVING HIGH MAGNETIC FLUX DENSITY

This application is a continuation of now abandoned application Ser. No. 07/685,893 filed Apr. 16, 1991, now abandoned.

BACKGROUND OF THE INVENTION (1) Field of the Invention

This invention relates to a process for manufacturing a double oriented electrical steel sheet including crystallized grains whose easy axis <001> of magnetization is oriented both in the longitudinal orientation and in the direction vertical thereto, together with the rolled surfaces exhibiting {100} planes (those crystallographic orientations can be represented as {100} <001> in the Miller indices).

(2) Description of the Related Art

Since the double oriented electrical steel sheet has excellent magnetic properties in the two different directions (e.g. $B_8$ values both in the rolled direction and in the direction vertical thereto: 1.92 Tesla), because of its easy axis (<001> axis) in the rolled direction and in the direction vertical thereto, it can be more advantageously used for a magnetic core material of a specific apparatus, e.g. a large-scale rotating machine, where the magnetic flux flows in two different directions in comparison with a grain oriented electrical steel sheet which exhibits excellent magnetic properties in only one rolled direction. Non-oriented electrical steel sheets, whose easy axis is not greatly accumulated, have generally been used for a small stationary machine or installation. The use of a double oriented electrical steel sheet, therefore, makes it a possible to miniaturize the machine with an increased efficiency.

The double oriented electrical steel sheet, which has excellent magnetic properties as described above, has long been expected to be put into mass production, but the general use of such a type of sheet as an industrial product is still limited at present. Although various methods have been suggested, these are all only on a laboratory scale and have problems in terms of the industrial scale of the process.

As a prior art technique, a method wherein an initial steel sheet is annealed at a high temperature in an atmosphere containing a polar gas, e.g., hydrogen sulfide, to secondarily recrystallize out {100} <001> oriented grains with the aid of surface energy is described in Japanese Examined Patent Publication No.37-7110. Nevertheless, this method is inadequate for mass production, because it requires a very accurate control of the surface energy of the sheet. The other method is that wherein a steel sheet is cold-rolled in one direction and further cold-rolled in the direction vertical thereto, i.e. a "cross cold-rolling method", as described in Japanese Examined Patent Publication No. 35-2657 by Satoru Taguchi et. al. According to the cold-rolling method, a relatively higher magnetization property ($B_8$ value) can be obtained, but the resulting product does not have a magnetization property which offsets the cost, and thus cannot replace the conventional grain oriented electrical steel sheet.

The magnetization property "$B_8$ value" of the grain oriented electrical steel sheet has been significantly improved since the technique disclosed in Japanese Examined Patent Publication No. 40-15644 and were invented. The $B_8$ value of equal to or more than 1.88 Tesla is standardized by JIS (Japanese Industrial Standard), and products having a $B_8$ value of about 1.92 Tesla have been commercially available. Under the above-mentioned situations, the product of double oriented electrical steel sheet is required to have a magnetization property ($B_8$ value) corresponding to the above-mentioned grain oriented electrical steel sheet. As processes for improving the magnetic flux density of double oriented electrical steel sheet, a process wherein a hot-rolled material is annealed and then cold-rolled in the mutually rectangular direction is disclosed in Japanese Examined Patent Publication 38-8213, a process wherein a material is nittided in the course from post-primary recrystallization is disclosed to the start of secondary recrystallization is disclosed in Japanese Examined Patent Publication 1-43818, and a process wherein after the cross cold-rolling, the material is further cold-rolled in the initial cold-rolled direction at a reduction rate of 5–33% is disclosed in Japanese Unexamined Patent Publication 1-272718.

SUMMARY OF THE INVENTION

The present invention is aimed at the establishment of a process capable of stably manufacturing a double oriented electrical steel sheet having a high magnetic flux density.

That is, the present invention is intended to provide a process for manufacturing a double oriented electrical steel sheet having a high magnetic flux density characterized by hot-rolling a silicon steel slab comprising 1.8–4.8% by weight of Si, 0.008–0.048% by weight of acid soluble Al, 0.0028–0.0100% by weight of total N, not more than 0.016% by weight of S and the balance being Fe and unavoidable impurities into a hot-rolled sheet, subjecting the sheet to cold-rolling at a reduction rate of 40–80%, subsequently subjecting the sheet to another cold-rolling at a reduction rate of 30–70% in the direction crossing perpendicularly to the said cold-rolled direction, annealing at 750°–950° C. in a wet hydrogen atmosphere for decarburization, and carrying out the final finishing annealing which comprises a stage for completing the secondary recrystallization at a temperature of 920°–1100° C. followed by a stage for purification.

Also provided by the present invention is a process for manufacturing a double oriented electrical steel sheet having a high magnetic flux density characterized by hot-rolling a silicon steel slab comprising 1.8–4.8% by weight of Si, 0.008–0.048% by weight of acid soluble Al, not more than 0.016% by weight of S and the balance being Fe and unavoidable impurities into a hot-rolled sheet, subjecting the sheet to cold-rolling at a reduction rate of 40–80%, subsequently subjecting the sheet to another cold-rolling at a reduction rate of 30–70% in the direction crossing perpendicularly to the said cold-rolled direction, annealing at 750°–950° C. under a wet hydrogen atmosphere for decarburization, subsequently nitriding the sheet so that the total N content in the raw material is 0.002–0.060% by weight at any time during the former annealing stage for decarburization, during an additional annealing stage thereafter, or during the heating stage in the final finishing annealing stage by the time of the start of the secondary recrystallization, and carrying out the final finishing annealing which comprises a stage for completing the secondary recrystallization at a temperature of 920°–1100° C. followed by a stage for purification.

DESCRIPTION OF THE PREFERRED EMBODIMENTS

Figure 1:
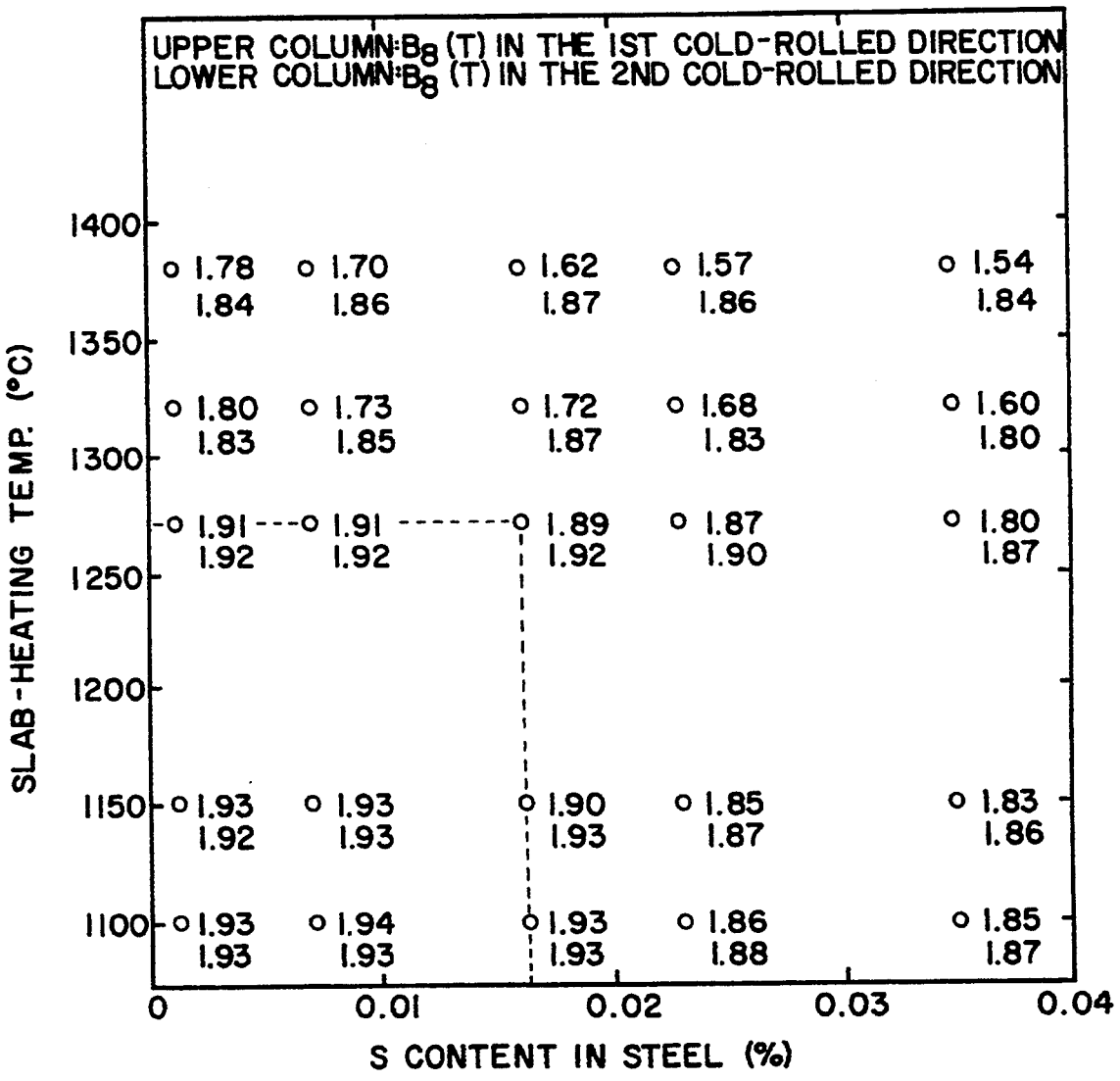
FIG. 1 and FIG. 2 show the steel and the magnetic flow density ($B_8$ value) of the product with a varied amount of S in the steel and a varied slab heating temperature.

A basic metallurgical principal applied in the process of manufacturing a double oriented electrical steel sheet is a phenomenon of secondary recrystallization. The following factors have been known for regulating the secondary crystallization:

(1) a primarily recrystallized texture that is easy to grow crystalline grains having an objective crystal orientation;

(2) fine precipitates or substitutional elements that have the effect of suppressing the growth of crystalline grains having orientations deviating from the object, i.e., the existence of an inhibitor;

(3) a grain size distribution of primarily recrystallized grains which is as uniform as possible and of suitable average size; and (4) a secondary recrystallization annealing cycle that selectively grows the objective grains with a steel sheet possessing the requirements of (1), (2), and (3). All of these factors are known in the production of grain oriented electrical steel sheets, but have not yet been known in the production of double oriented electrical steel sheets. According to our investigation, the techniques disclosed in Japanese Examined Patent Publication No. 35-2657, and Japanese Unexamined Patent Publication No. 1-272718 as mentioned above deal with the factor of (1), and the technique described in Japanese Examined Patent Publication No. 1-43818 deals with the factor of (2).

The inventors discovered a novel finding concerning factor (4), which was filed as Japanese Patent Application No. 63-293645 (Japanese Unexamined Patent Publication No. 2-141531). Specifically, a {110} <UVW> orientation exists together with the desired "{100} <001>" orientation, in the secondarily recrystallized grains obtained in the cross cold-rolling method. The larger the orientation, {110} <UVW>, the more the $B_8$ is deteriorated. Furthermore, the secondary recrystallization temperature of {110} <UVW> oriented grains has been found to be higher than that of {100} <001> oriented grains. By completing the secondary recrystallization at the relatively lower temperature ranging from 920° to 1100° C., the rate of the {100} <001> oriented grains is enhanced before the growth of {110} <UVW> oriented grains, and this makes it possible to improve $B_8$. This invention provides conditions which can completely realize this technical idea, and make it possible to obtain a high magnetic flux density stably. In addition, the present invention, which can shorten the annealing cycle for the secondary recrystallization, has the advantageous effect of lowering the production cost.

The contents of the present invention will now be explained specifically.

In the secondary recrystallization for the purpose of producing a double oriented electrical steel sheet, an S type (MnS) inhibitor has hitherto been used as is available. However, we have discovered that this MnS inhibitor is rather harmful in the production of a double oriented electrical steel sheet in the secondary recrystallization. Its existence is the cause for deterioration of the magnetic flux density.

The inventors conducted the following experiments concerning the S type inhibitor:

A molten steel containing 0.049% by weight of C, 3.25% by weight of Si, 0.14% by weight of Mn, 0.27% by weight of acid soluble Al, and 0.0073% by weight of total N was divided into five portions, and slabs wherein the content of S (% by weight) was adjusted to 0.0010%, 0.0070%, 0.016%, 0.023%, and 0.035%, respectively were cast. After coarsely rolling the slabs, they were divided into five portions. The coarsely rolled materials were heated at 1100° C., 1150° C., 1270° C., 1320° C., and 1380° C., respectively, to produce hot-rolled sheets having a 1.5 mm thickness. The sheets were annealed at 1000° C. for 2 minutes, and then cold-rolled into the thickness of 0.55 mm in the same direction as in the hot-rolled direction. Subsequently, the sheet was cold-rolled into a 0.23 mm thickness in the direction vertical to that of the first cold-rolled direction (cross cold-rolling). Thereafter, the rolled sheet was subjected to decarburization and annealing in a wet hydrogen atmosphere at 820° C. for 120 seconds, MgO containing 3% ferromanganese being applied thereto. The sheet was then heated up to 1200° C. at a heating rate of 30° C./hr in an atmosphere of 75% $H_2$+25% $N_2$, and then annealed at 1200° C. for 20 minutes in a 100% $H_2$ atmosphere. The magnetic flux densities of the resulting products are shown in FIG. 1. It can be understood from FIG. 1 that the lower the content of S in the steel is and the lower the slab-heating temperature is, the higher the $B_8$ value is. From the measurement of the orientation of crystalline grains of this product, the product having a higher S content in the steel and obtained at the higher slab-heating temperature contained more {110} <UVW> oriented grains. From the repeated observations of the steel sheet during the heating in the annealing for the secondary recrystallization, it was found that the higher the content of S in the steel is and the higher the slab-heating temperature is, the more the tendency to delay the progress of the secondary recrystallization is. It can thus be assumed that when the content of S is larger and the slab heating temperature increased, MnS is dissolved in a larger amount and MnS precipitates become more and finer. Therefore, the effect of suppressing the grain growth as inhibitor is enhanced, thereby delaying the progress of the secondary recrystallization. Such delaying of the progress of the secondary recrystallization makes the phenomenon that "{100} <001>orientation appears at a low temperature and {110} <UVW> orientation appears at a high temperature" more significant, thereby deteriorating the $B_8$ value.

As described above, in spite of the common sense of availability of MnS in the secondary recrystallization for the production of a grain oriented electrical steel sheet, excess MnS was rather found to have an adverse effect upon the secondary crystallization of {100} <001> orientation, which is a double oriented electrical steel sheet. Based on this new acknowledgement, the present invention was constructed as follows:

The content of Si as the steel component will now be restricted. If the content of Si exceeds 4.8% by weight, the material tends to crack on cold-rolling and, hence, it is difficult to carry out the rolling. Conversely, the magnetic flux density becomes higher as the Si content gets smaller, but the orientation of crystals is destroyed if the transformation of $\alpha$ into $\gamma$ occurs at the annealing stage for the secondary crystallization. Consequently, the lower limit of the Si content is defined to be 1.8% by weight, avoiding the transformation of $\alpha$ into $\gamma$.

In the present invention, when forming the inhibitor from the initial stage of the process, it is necessary that 0.008–0.048% by weight of acid soluble Al, and 0.0028–0.0100% by weight of total N are contained. If the content of acid soluble Al is less than 0.008% by weight or the total content of N is less than 0.0028% by weight, no secondary re-crystallization occurs due to the shortage of the amount of the inhibitor. Conversely, if the content of acid soluble Al exceeds 0.048% by weight, no secondary recrystallization occurs because of the inhomogeneous distribution of AlN. Further, if the total content of N exceeds 0.0100% by weight, there arises a surface blemish called a "blister" which occurs during the stage of the hot-rolling and spreads during the stage of the cold-rolling. In the case of forming the inhibitor in an intermediate stage of the process, 0.008–0.048% by weight of acid soluble Al, is incorporated, and a nitriding is applied at any time during a short time decarburization stage after the final cold-rolling, during an additional annealing stage carried out thereafter, or during the heating up stage in the finishing annealing stage by the time of the start of the secondary recrystallization so that a nitride "AlN" or "(al,Si)N" is formed to be 0.002–0.060% by weight of the total N content to act as the inhibitor.

Because a high content of S changes the $B_8$ value for the worse, the content of S is defined to be not more than 0.016% by weight in the present invention.

A silicon steel slab containing the components mentioned above is hot-rolled into a hot-rolled sheet. As the gist of the present invention is that a solid dissolving of MnS by the heating of the slab is suppressed in order to decrease the inhibition effect of MnS upon the grain growth, preferably the slab-heating temperature is low. The upper limit of this temperature is 1270° C., so that no slag occurs. The lower limit may be a temperature capable of hot-rolling, for example, 1000° C. Immediately thereafter, or after further heating at a temperature of 750°–1200° C. for 30 seconds to 30 minutes for short time annealing, cold-rolling is applied in the lengthwise direction of the hot-rolled sheet and at the cross direction thereof. The application of this annealing is preferable in terms of enhancing the magnetic flux density of the product, but the production cost is increased. Consequently, whether or not the short time annealing is applied may be decided after taking into consideration the desired level of the magnetic flux density of the product.

The cold-rolling wherein the direction of the first cold-rolling is accorded with the hot-rolled direction of the stock can produce a product having a higher magnetic density than that obtained by the cold-rolling wherein the direction of the first cold-rolling is crossed perpendicular to the hot-rolled direction of the stock. However, in any case of the direction of the first rolling either accorded with or crossing perpendicular to the hot-rolled direction of stock, the resulting product is always a double oriented electrical steel sheet having {100} <001> orientation or an orientation in the same vicinity. Generally, in order to remove a small amount of C contained in the steel, the material after cold-rolling is subjected to decarburization at 750°–950° C. for a short time in a wet hydrogen atmosphere.

The means for the formation of an inhibitor by the nitriding treatment in the course from post-final cold-rolling to the start of the secondary recrystallization in the finishing annealing stage, which is one embodiment of the present invention, will now be explained.

The means for penetrating nitrogen into the steel sheet which can be used should not be specifically restricted, but include, for example, a method wherein the cold steel sheet is nitrided during decarburization annealing in an atmosphere having nitriding capability, e.g. in an atmosphere containing ammonia gas; a method wherein the decarburized steel sheet is additionally annealed and at this time, the steel sheet is nittided; or a method wherein the decarburized steel sheet is nittided in the early stage of finishing annealing before the start of secondary recrystallization in the atmosphere having a nitriding capability.

Where the subject of the finishing annealing mentioned above is a strip coil, especially of a large size, it is difficult to penetrate nitrogen into a space between the strip layers and thus there is a fear of insufficient and inhomogeneous nitriding of the steel sheet. Consequently, it is desirable to secure the gaps between sheets to a level more than a specific value, or to take means for adding a metal nitride which discharges nitrogen in the course of the finishing annealing, into an annealing separator such as an ammono compound, prior to the finishing annealing.

Further, the decarburized sheet or the nitriding treated sheet is finally annealed after the application of an annealing separator such as MgO. As a finishing annealing condition, it is essential that the secondary crystallization is completed at a temperature of 920°–1100° C. The concrete means for expressing the secondary crystallization is either to be maintained at a temperature of 920°–1100° C. for a period of 5 hours or more, which is the period for the secondary crystallization to be completed, or to heat up the temperature at a rate not more than 30° C./hr in the temperature range mentioned above. Since it is an essential condition of the present invention for the inhibition effect of MnS on the grain growth to be as low as possible, the secondary recrystallization can be completed at a lower temperature and for shorter time, and thus, the heating rate can be higher in comparison with the prior filed patent (Japanese Unexamined Patent Publication No. 2-141531). The present invention, therefore, lowers the higher production cost due to the higher annealing efficiency. The sheet in which the secondary crystallization has been thus completed is annealed at a temperature of 1150°–1200° C. for 5–20 hours in a hydrogen atmosphere for the purpose of purification such as for removing N and S.

The working examples will now be explained.

EXAMPLE 1

Figure 2:
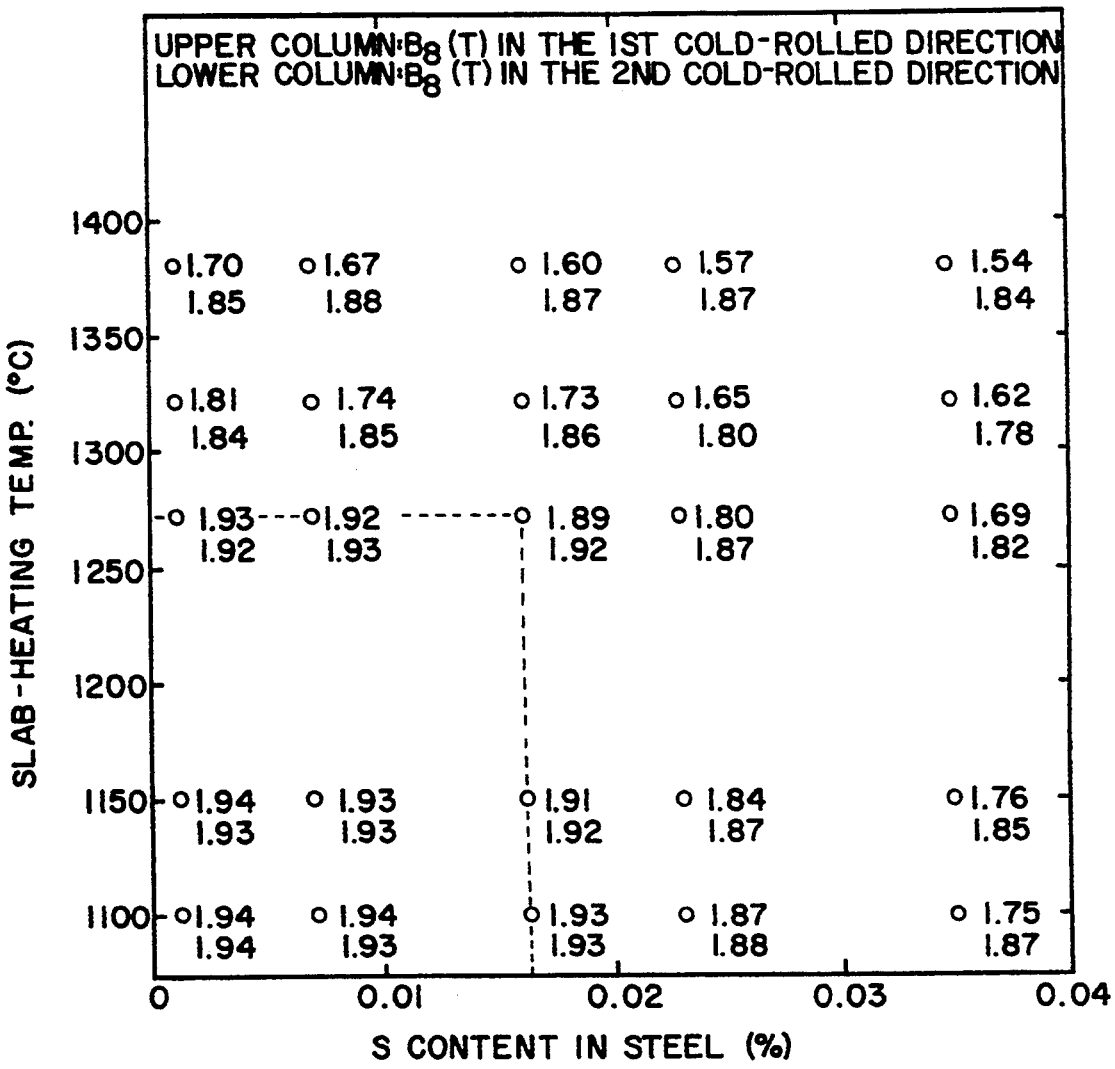

The same hot-rolled sheet having a 1.5 mm thickness, as the hot-rolled sheet used for obtaining the results of FIG. 1, was annealed at 1000° C. for 2 minutes, and then cold-rolled in the same direction as the hot-rolled direction into a 0.55 mm thickness. Subsequently, the sheet was cold-rolled in a direction vertical to the first cold-rolled direction into a 0.23 mm thickness (cold cross-rolling). The sheet was then annealed in a wet hydrogen atmosphere at 820° C. for 120 seconds for decarburization, and then MgO containing 3% ferromanganese nitride was applied thereto. The sheet was heated up to 1020° C. at a heating rate of 50° C./hr, maintained in a 75% $H_2$+25% $N_2$ atmosphere for 20 hours to secondarily recrystallize out. Thereafter, it was heated up to 1200° C. at a heating rate of 25° C./hr, and maintained in a 100% $H_2$ atmosphere to be purified. The magnetic properties of the resulting product are shown in FIG. 2.

EXAMPLE 2

Two kinds of cast strips containing 0.048% by weight of C, 3.30% by weight of Si, 0.070% by weight of acid soluble Al, 0.0072% by weight of total N, and the balance being Fe and unavoidable impurities, which further contained either 0.0060% by weight or 0.021% by weight of S were heated to 1150° C. or 1320° C., and then hot-rolled into hot-rolled sheets having a 1.8 mm thickness. The sheet was annealed at 1000° C. for 2 minutes, and then cold-rolled in the same direction as the hot-rolled direction into a 0.75 mm thickness. Subsequently, the sheet was cold-rolled in a direction vertical to the firstcold-rolled direction into a 0.30 mm thickness. The sheet was then annealed in a wet hydrogen atmosphere at 820° C. for 150 seconds for decarburization, and then MgO containing 3% ferromanganese nitride was applied thereto. The sheet was heated up to 1020° C. at a heating rate of 50° C./hr in a 75% $H_2$+25% $N_2$ atmosphere, and maintained for either of 5 hours, 10 hours, or 20 hours to secondarily recrystallize out. In any case, the sheet was then heated up to 1200° C. at a heating rate of 25° C. /hr, and maintained in a 100% $H_2$ atmosphere for 20 hours to be purified. The magnetic properties of the resulting products are shown in Table 1.

The product having a small content of S in the steel had a higher $B_8$. However, in the case where a higher slab heating temperature, i.e. 1320° C. was applied, longer soaking time was required for the secondary recrystallization to obtain high $B_8$ values. The product having a content of S as large as 0.021% by weight in the steel did not have a high $B_8$. Especially, in the case of a lower slab heating temperature and a longer soaking time for the secondary recrystallization, poor secondary recrystallization (the portion where secondary recrystallization is not completed) was observed (marked by * in the table).

TABLE 1

| S content in Steel (%) | Slab-Heating Temp. (°C.) | Soaking time of annealing for secondary recrystallization: 5 hours, $B_8$ (T) in 1st cold-rolled direction | 5 hours, $B_8$ (T) in 2nd cold-rolled direction | 10 hours, $B_8$ (T) in 1st cold-rolled direction | 10 hours, $B_8$ (T) in 2nd cold-rolled direction | 20 hours, $B_8$ (T) in 1st cold-rolled direction | 20 hours, $B_8$ (T) in 2nd cold-rolled direction |
|---|---|---|---|---|---|---|---|
| 0.006 | 1150 | 1.94 | 1.93 | 1.94 | 1.94 | 1.94 | 1.94 |
| | 1320 | 1.75 | 1.85 | 1.77 | 1.86 | 1.81 | 1.87 |
| 0.021 | 1150 | 1.60 | 1.80 | 1.80 | 1.82 | 1.70* | 1.84* |
| | 1320 | 1.56 | 1.70 | 1.57 | 1.85 | 1.54 | 1.87 |

*: Incomplete Secondary Recrystallization

EXAMPLE 3

Cast strips containing 0.048% by weight of C, 3.27% by weight of Si, 0.13% by weight of Mn, 0.0060% by weight of S, and the balance being Fe and unavoidable impurities, which further contained an amount of acid soluble Al and a total amount of N listed in Table 2 were heated to 1230° C., and then hot-rolled into hot-rolled sheets having a 1.8 mm thickness. The sheets were annealed at 1000° C. for 2 minutes, and then cold-rolled in the same direction as the hot-rolled directions into a 0.75 mm thickness. Subsequently, the sheets were cold-rolled in a direction vertical to the first cold-rolled direction into a 0.30 mm thickness. The sheets were then annealed in a wet hydrogen atmosphere at 800° C. for 150 seconds for decarburization, and then MgO was applied thereto. The sheets were heated up to 1000° C. at a heating rate of 50° C./hr in a 75% $H_2$+25% $N_2$ atmosphere, and maintained for 10 hours. Subsequently, the sheets were then heated :up to 1200° C. at a heating rate of 25° C. /hr, and maintained for 20 hours in a 100% H2 atmosphere to be purified. The magnetic properties of the resulting products are2shown in Table 2.

TABLE 2

| Sample No. | Acid soluble Al content Steel (%) | N content in Steel (%) | $B_8$ (T) in 1st cold-rolled direction | $B_8$ (T) in 2nd cold-rolled direction |
|---|---|---|---|---|
| 1 | 0.028 | 0.0023 | 1.85 | 1.80 |
| 2 | 0.028 | 0.0078 | 1.90 | 1.91 |
| 3 | 0.007 | 0.0079 | 1.68 | 1.58 |
| 4 | 0.027 | 0.0076 | 1.91 | 1.91 |
| 5 | 0.052 | 0.0077 | 1.57 | 1.56 |

In the sample deviating from the present invention, i.e., that which had a small N content in the steel (sample No.1), that which had too little an acid soluble Al content (sample No.3) and too high a soluble Al content (sample No.5), most portions did not secondarily crystallize out and had a low $B_8$.

EXAMPLE 4

Cast strips containing 0.048% by weight of C, 3.27% by weight of Si, 0.13% by weight of Mn, 0.0060% by weight of S, and the balance being Fe and unavoidable impurities, which further contained an amount of acid soluble Al and a total amount of N listed in Table 3 were heated to 1230° C., and then hot-rolled into hot-rolled sheets having a 1.8 mm thickness. The sheets were annealed at 1000° C. for 2 minutes, and then cold-rolled in the same direction as the hot-rolled direction into a 0.75 mm thickness. Subsequently, the sheet were cold-rolled in a direction vertical to the first cold-rolled direction into a 0.30 mm thickness. The sheets were then annealed in a wet-hydrogen atmosphere at 800° C. for 150 seconds for decarburization. After about 0.120% of N was added in an ammonia atmosphere, MgO was applied to the sheets. The sheets were heated up to 1000° C. at a heating rate of 50° C./hr in a 75% $H_2$+25% $N_2$ atmosphere, and maintained for 10 hours. Subsequently, the sheets were then heated up to 1200° C. at a heating rate of 25° C. /hr, and maintained for 20 hours in a 100% H atmosphere to be purified. The magnetic properties of the resulting products are shown in Table 3.

TABLE 3

| Sample No. | Acid soluble Al content in Steel (%) | N content in Steel (%) | $B_8$ (T) in 1st cold-rolled direction | $B_8$ (T) in 2nd cold-rolled direction |
|---|---|---|---|---|
| 1 | 0.028 | 0.0023 | 1.92 | 1.90 |
| 2 | 0.028 | 0.0078 | 1.94 | 1.93 |
| 3 | 0.007 | 0.0079 | 1.72 | 1.67 |
| 4 | 0.027 | 0.0076 | 1.93 | 1.94 |
| 5 | 0.052 | 0.0077 | 1.63 | 1.57 |

In the samples deviating from the present invention, i.e. that which had too little a soluble Al content (sample No. 3) or too high a soluble Al content (sample No. 5), most portions did not secondarily crystallize out and had a low $B_8$.

EXAMPLE 5

Cast strips containing 0.048% by weight of C, 3.27% by weight of Si, 0.13% by weight of Mn, 0.0060% by weight of S, 0.028% by weight of acid soluble Al, 0.028% by weight of total N, and the rest of Fe and unavoidable impurities were heated to 1230° C., and then hot-rolled into hot-rolled sheets having a 1.8 mm thickness. One of the sheets was directly cold-rolled and the other was cold-rolled after annealing at 1000° C. for 2 minutes, in the same direction as the hot-rolled and the other into a 0.75 mm thickness. Subsequently, the sheet was cold-rolled in the direction vertical to the first cold-rolled direction into a 0.30mm thickness. The sheets were then annealed in a wet hydrogen atmosphere at 820° C. for 150 seconds for decarburization, and then MgO containing 3% ferromanganese was applied thereto. The sheets were heated up to 1100° C. at a heating rate of 20° C./hr in a 75% $H_2$+25% $N_2$ atmosphere, and maintained for 10 hours. Subsequently, the sheets were then heated up to 1200° C. at a heating rate of 50° C. /hr, and maintained for 20 hours in a 100% H2 atmosphere to be purified. The magnetic characteristics of the resulting products are shown in Table 4.

TABLE 4

| Annealing of Hot-rolled Sheet | $B_8$ (T) in 1st cold-rolled direction | $B_8$ (T) in 2nd cold-rolled direction |
|---|---|---|
| None | 1.83 | 1.80 |
| 1000° C. for 2 min. | 1.93 | 1.93 |

By annealing the hot-rolled sheet, a product having a high $B_8$ could be obtained.

As described above, the present invention can efficiently and stably produce a double oriented electrical steel sheet having a similar or better $B_8$ value than that of the best current level of grain oriented electrical steel sheet.

We claim:

1. A process for manufacturing a double oriented electrical steel sheet having a high magnetic flux density $B_8$ (T) of at least 1.89, which comprises providing a silicon steel slab comprising 1.8–4.8% by weight of Si, 0.008–0.048% by weight of acid soluble Al, 0.0028–0.0100% by weight of total N, 0.0010 to 0.016% by weight of S and the balance being Fe and unavoidable impurities, heating the silicon steel slab to about 1000° to 1270° C., hot-rolling the silicon steel slab into a hot-rolled sheet, subjecting the sheet to cold-rolling at a reduction rate of 40–80%, subsequently subjecting the sheet to another cold-rolling at a reduction rate of 30–70% in a direction crossing perpendicularly to a direction of said cold-rolling, annealing the sheet at 750°–950° C. in a wet hydrogen atmosphere for decarburization, and carrying out final finishing annealing of the sheet which comprises a stage for completing secondary recrystallization at a temperature of 920°–1100° C. followed by a stage for purification.

2. A process for manufacturing a double oriented magnetic steel sheet having a high magnetic flux density $B_8$ (T) of at least 1.89, which comprises providing a silicon steel slab comprising 1.8–4.8% by weight of Si, 0.008–0.048% by weight of acid soluble Al, 0.0010to 0.016% by weight of S and the balance being Fe and unavoidable impurities, heating the silicon steel slab to about 1000° to 1270° C., hot-rolling the silicon steel slab into a hot-rolled sheet, subjecting the sheet to cold-rolling at a reduction rate of 40–80%, subsequently subjecting the sheet to another cold-rolling at a reduction rate of 30–70% in a direction crossing perpendicularly to a direction of said cold-rolling, annealing the sheet at 750°–950° C. in a wet hydrogen atmosphere for decarburization, subsequently nitriding the sheet so that the total N content in the raw material is 0.002–0.060% by weight at any time during the annealing stage for decarburization, during an additional annealing stage thereafter, or during a heating stage in a final finishing annealing stage by the time of the start of secondary recrystallization, and carrying out final finishing annealing which comprises a stage for completing secondary recrystallization at a temperature of 920°–1100° C. followed by a stage for purification.

3. The process of claim 1, wherein the hot-rolled sheet is annealed at a temperature of 750°–1200° C. for 30 seconds to 30 minutes prior to the first cold-rolling.

4. The process of claim 2, wherein the hot-rolled sheet is annealed at a temperature of 750°–1200° C. for 30 seconds to 30 minutes prior to the first cold-rolling.

* * * * *